US005222926A

United States Patent [19]

Eggen

[11] Patent Number: 5,222,926

[45] Date of Patent: Jun. 29, 1993

[54] HAND EXERCISE DEVICE

[76] Inventor: Harald I. Eggen, 5415 Fox Lake Rd., McHenry, Ill. 60050

[21] Appl. No.: 817,535

[22] Filed: Jan. 7, 1992

[51] Int. Cl.[5] ..... A63B 23/16

[52] U.S. Cl. ..... 482/49; 482/122; 482/126

[58] Field of Search ..... 482/44, 49, 121, 122, 482/126, 127

[56] References Cited

U.S. PATENT DOCUMENTS

| | | | |
|---|---|---|---|
| 3,670,574 | 6/1972 | Edwards . | |
| 3,807,729 | 4/1974 | Sigma . | |
| 4,262,898 | 4/1981 | Lee . | |
| 4,433,364 | 2/1984 | Noble . | |
| 4,558,864 | 12/1985 | Medwedeff . | |
| 4,578,769 | 3/1986 | Frederick . | |
| 4,623,141 | 11/1986 | Salvino | 482/49 |
| 4,632,384 | 12/1986 | Bright | 482/49 |
| 4,697,278 | 9/1987 | Fleischer . | |
| 4,700,369 | 10/1987 | Siegal et al. . | |
| 4,714,245 | 12/1987 | Cho . | |
| 4,729,560 | 3/1988 | Cho . | |
| 4,741,001 | 4/1988 | Ma . | |
| 4,749,183 | 6/1988 | Cho . | |
| 4,753,434 | 6/1988 | Salvino | 482/49 |
| 4,780,864 | 10/1988 | Houlihan . | |
| 4,823,367 | 4/1989 | Kreutzfeld . | |
| 4,881,187 | 11/1989 | Read . | |
| 4,932,045 | 6/1990 | Kasoff et al. . | |
| 4,943,047 | 7/1990 | Noble . | |
| 5,060,934 | 10/1991 | Winston | 482/49 |
| 5,072,927 | 12/1991 | Santos | 482/44 |

*Primary Examiner*—Richard J. Apley
*Assistant Examiner*—Lynne A. Reichard
*Attorney, Agent, or Firm*—Mathew R. P. Perrone, Jr.

[57] ABSTRACT

A spring is made of a flexible plastic material in generally arcuate shape. This spring of adjustable strength is especially suitable for use in a hand exercising device, which may have optional inserts which, in turn, serve to increase or reduce the strength the grip required; and an optional counting mechanism to indicate desired features of exercise with the grip such as repetitions or time.

11 Claims, 5 Drawing Sheets

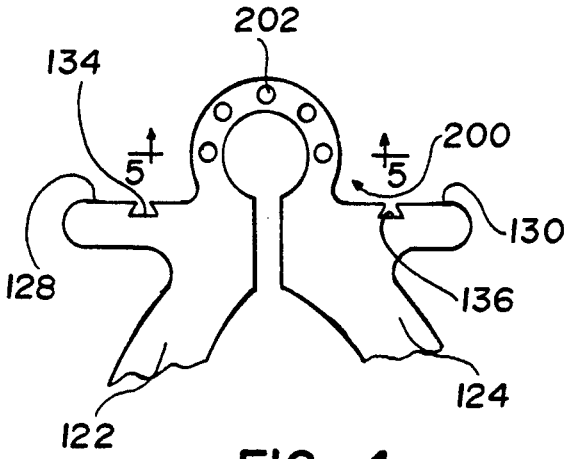
FIG. 4
FIG. 5
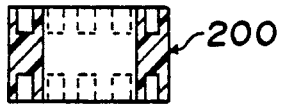
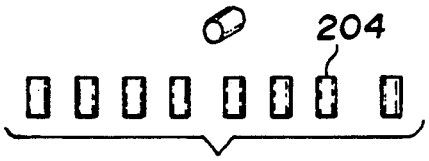
FIG. 6
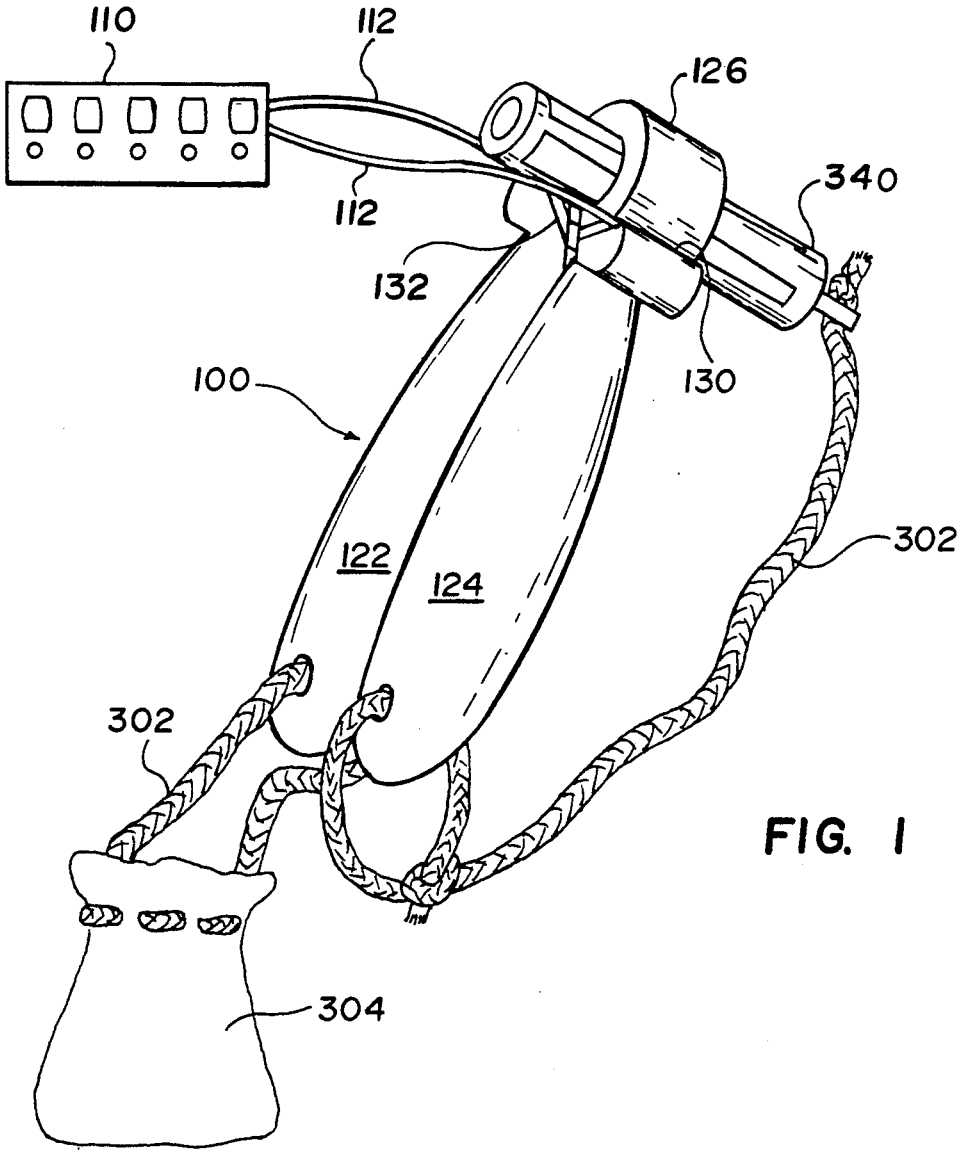
FIG. 1

FIG. 8
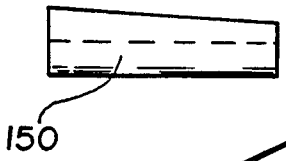
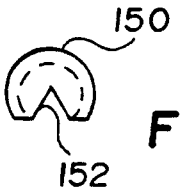
FIG. 9
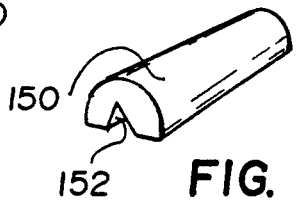
FIG. 7
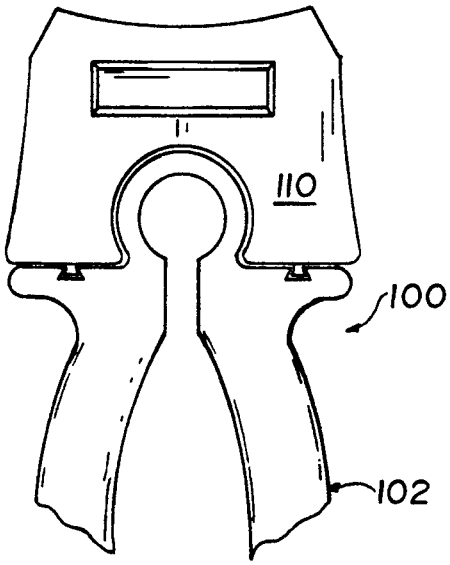
FIG. 2
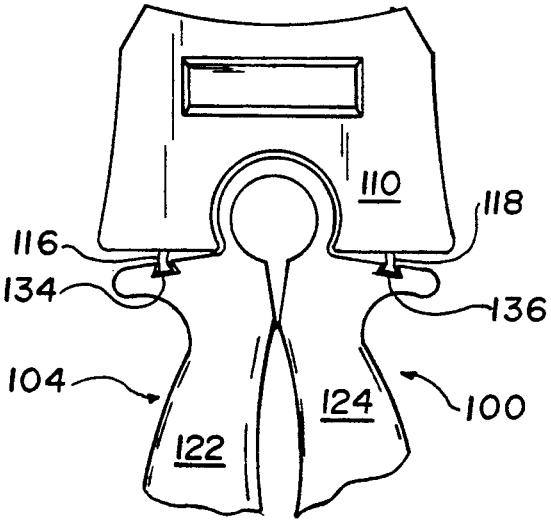
FIG. 3

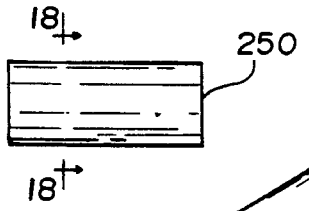
FIG. 17
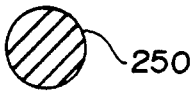
FIG. 18
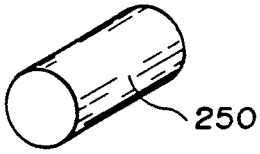
FIG. 16
FIG. 20
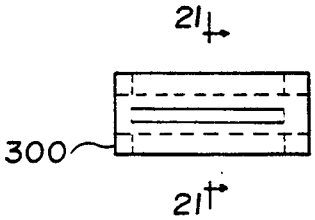
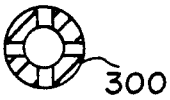
FIG. 21
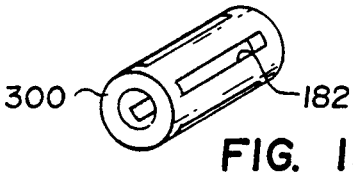
FIG. 19
FIG. 23
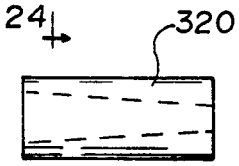
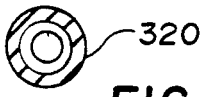
FIG. 24
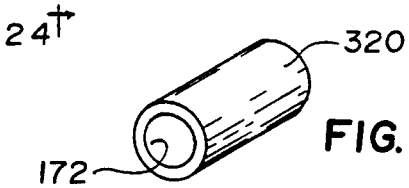
FIG. 22
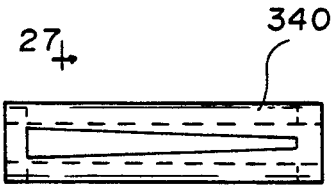
FIG. 26
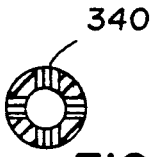
FIG. 27
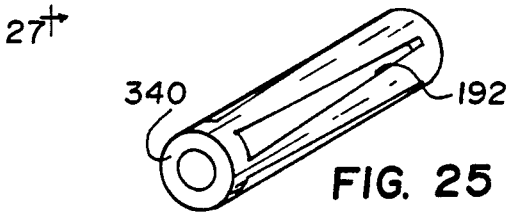
FIG. 25

FIG. 28
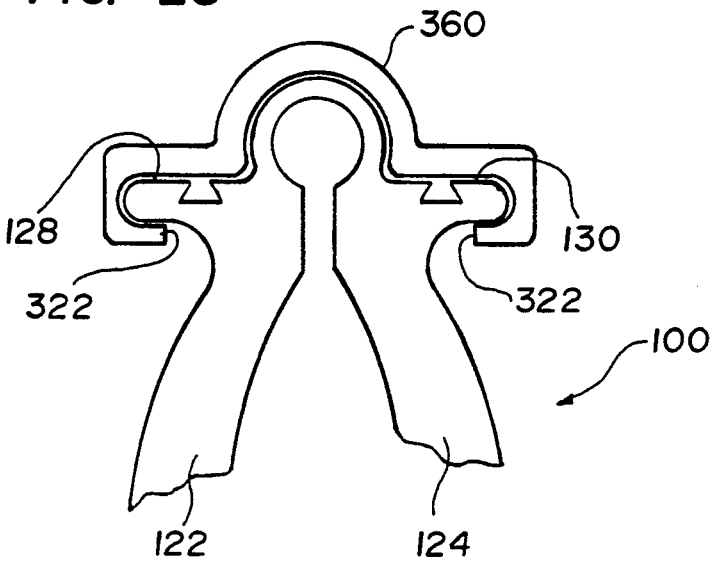
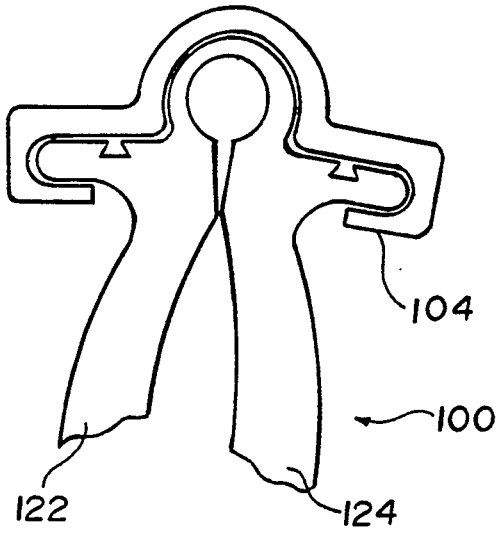
FIG. 29

HAND EXERCISE DEVICE

This invention relates to a spring of adjustable strength, and more particularly to a spring of adjustable strength being especially suitable for use in a hand exercising device having inserts available therefor which serve to increase or reduce the strength the grip required and a counting mechanism to indicate desired features of exercise with the grip, such as repetitions or time.

BACKGROUND OF THE INVENTION

A spring may have many uses. One problem with a spring is that it has only one strength. When a spring of a different strength is required, it is required to completely replace the spring. Such a replacement is not always convenient. But there is no appropriate manner of changing the spring strength. If there were such a spring with a variable strength, a hand exercising device is an especially suitable use therefor.

Hand exercising devices are well known to a fitness expert, a physical therapist, and a person needing or wanting to exercise a hand. A hand exercising device can generally include a pair of spring-connected arms. The arms are supported and joined at one end by a spring. The end of each arm opposite the spring is movable in relation to the other arm. These arms are generally squeezed toward each other with the spring or other support mechanism therebetween having a return device to permit the arms of the device to be forced apart.

Such a repeated squeezing of the device can greatly strengthen a hand. However, it is difficult to get an accurate reading of the actual exercise that is being accomplished by using this device. It is also difficult to increase strength required to squeeze the device as the hands get stronger. Thus, many of the hand exercising devices have a substantial number of problems that cannot be overcome.

The only accurate way to overcome the problems with regard to measurement at this time is to have a plurality of devices and a complicated connection mechanism to get to the desired readouts. Such complications add to price and detract from the capability of the device being readily accessable for exercise. Also, as the complexity of the device increase, the cost increases and the manufacturing skill required increases.

Thus, these changes in strength, or readout or other aspects of a hand exercising device complicate the matter. It is highly desired to simplify a change in strength and a change in readout on a hand exercising device.

SUMMARY OF THE INVENTION

Therefore, it is an objective of this invention to provide a spring having many uses.

A further objective of this invention is to provide a variable strength spring.

A still further objective of this invention is to provide a device to avoid completely replacing a spring.

Yet a further objective of the invention is to provide a spring suitable for use in a hand exercising device.

Also an objective of this invention is to provide a hand exercising device capable of measuring the actual exercise.

Another objective of this invention is to provide a hand exercising device having variable strength.

Yet another objective of this invention is to provide a hand exercising device serving a variety of strengths.

Still another objective of this invention is to provide a hand exercising device capable of timing the exercise.

These and other objectives of the invention (which other objectives become clear by consideration of the specification, claims and drawings as a whole) are met by providing a spring of adjustable strength. This spring of adjustable strength is especially suitable for use in a hand exercising device, which may have optional inserts which, in turn, serve to increase or reduce the strength the grip required; and an optional counting mechanism to indicate desired features of exercise with the grip, such as repetitions or time.

BRIEF DESCRIPTION OF THE DRAWINGS

FIG. 1 depicts a perspective view of a hand exercising device 100 of this invention with electronic counter 110 shown in an exploded fashion.

FIG. 2 depicts a side view of a hand exercising device 100 of this invention with electronic counter 110 attached in open form 102.

FIG. 3 depicts a side view of a hand exercising device 100 of this invention with electronic counter 110 attached in closed form 104.

FIG. 4 depicts a side view of cratered exercising device 200 of this invention.

FIG. 5 depicts a top plan sectional view of cratered exercising device 200 of this invention along Line 3—3.

FIG. 6 depicts a perspective view of a probe 204 for use with cratered exercising device 200 of this invention.

FIG. 7 depicts a perspective view of a slotted insert 150.

FIG. 8 depicts a side view of a slotted insert 150.

FIG. 9 depicts an end plan view of a slotted insert 150.

FIG. 16 depicts a perspective view of a cylindrical insert 250.

FIG. 17 depicts a side view of a cylindrical insert 250.

FIG. 18 depicts a cross-section of FIG. 16 along Line 18—18.

FIG. 19 depicts a perspective view of a grooved insert 300.

FIG. 20 depicts a side view of a grooved insert 300.

FIG. 21 depicts a cross-section of FIG. 19 along Line 21—21.

FIG. 22 depicts a perspective view of a hollow cylindrical insert 360.

FIG. 23 depicts a side view of a hollow cylindrical insert 320.

FIG. 24 depicts a cross-section of FIG. 21 along Line 24—24.

FIG. 25 depicts a perspective view of a gapped insert 340.

FIG. 26 depicts a side view of a gapped insert 340.

FIG. 27 depicts a cross-section of FIG. 25 along Line 27—27.

FIG. 28 depicts a side view of a hand exercising device 100 of this invention with outer brace 320 in position.

FIG. 29 depicts a side view of a hand exercising device 100 in a closed one arm position 104.

Throughout the figures of the drawings, where the same part appears in more than one figure of the drawings, the same number is applied thereto.

DESCRIPTION OF THE PREFERRED EMBODIMENTS

Figure 10:
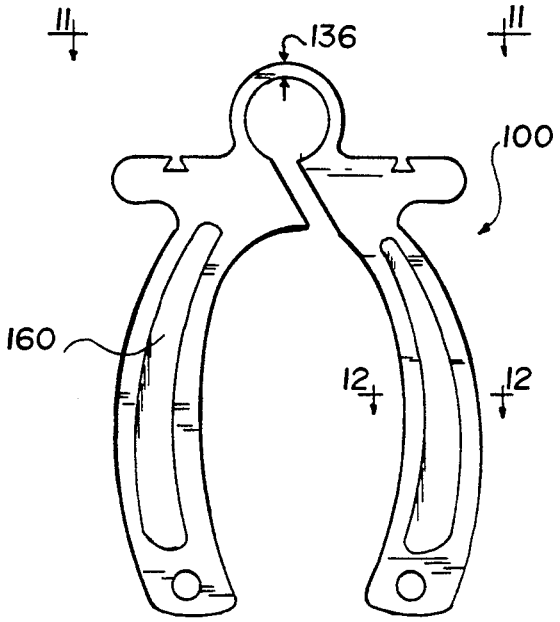
FIG. 10 depicts a side view of a hand exercising device 100 with indentations 160 in handles thereof.

An arcuate piece of flexible plastic or synthetic resin provides a spring mechanism having a unique utility. This unique utility function can provide for flexibility and adjustment in the strength in the spring. The thickness of the arcuate plastic can effectively adjust the strength of the spring both in the width of the arc or the thickness of the arc.

It is also possible to adjust the strength of the spring by providing for apertures in the edge of the spring into which appropriate pins may be inserted. As pins are inserted the strength of the spring is increased. As pins are removed the strength of the spring is decreased. It is also permitted to insert within the arcuate or cylindrical portion within the center of the spring a separate strength increasing structure. The size and shape of the insertion increases or decrease the strength as desired.

This particular spring may molded or otherwise incorporated into a hand exercising device. The hand exercising device is preferably molded or cut out of a solid piece of plastic. Other methods of forming the hand exercising device are also feasible. Any shapeable, flexible or resilient material or combinations thereof may be used form a suitable device. Plastic or synthetic resin materials are highly operable. A typical material is available under the registered trademark DELRIN from E. I. duPont of Wilmington, Del. A suitable metal with memory capability is also operable. For example, nickel-titanium alloys are known to have a memory. These alloys are commonly known as nitinol.

With the hand exercising device, there are two arms extending from a centrally located arcuate spring portion. Adjacent the arcuate portion are two ledges, one ledge at the top of each arm. The arcuate portion can receive a sleeve therewithin for increasing the strength required for operating the hand exercising device. In this fashion, one hand exercising device with a plurality of sleeves can serve many different people having different strength capability. A person using the device can also increase or decrease the resistance of the device as desired.

The sleeve is generally cylindrical in shape. It may be slotted, with the size of the slot varying the strength. The smaller the slot in the sleeve the more resistance provided to the hand exercising device and the greater the exercise results. With the cylindrical shape, the cylinder may be solid or hollow. As the diameter of the hollow portion of the cylinder increases, the resistance provided by the cylinder usually decreases.

On the shelves are two indentations capable of receiving switches. The switches are attached to or form a part of a standard electronic device. This electronic device can have readouts in terms of time elapsed, number of strokes in raw form and per unit time elapsed, force of squeezing, hand force applied to tee exercising device or other desired information.

A change of the device to a similar device capable of being electronically added thereto can provide a different readout or plurality thereof. On the device are the two switches that fit into the indentations. Squeezing of the hand exercising device activates the switches and thereby provides the readout for the device.

Within the arcuate portion, a variable strength sleeve may also be used. This variable strength sleeve is an elongated slotted sleeve with a tapered slot or other strength adjusting means therein. With the tapered slot along the sleeve, the strength added to the exercising device of this invention is adjusted, depending on which part of the variable sleeve is in the exercise device. The elongated sleeve can be slid through to increase or decrease the strength of hand exercise device as desired. The minor protrusion of the elongated sleeve does not interfere with the otherwise efficient operation.

Adjustment of the arcuate portion to form a cratered exercise device is also operable and is substantially similar to the above-described hand exercising device but for the fact that slots appear in the arcuate portion of the cratered exercise device. The slots may receive probes. The probes serve the purpose of strengthening or weakening the gripping required. Thus, the probes may be inserted into or removed from the slots to increase or decrease the strength of the exercise device as desired.

Either the hand exercising device or the insert may be marked with appropriate strength indications so that effort expended can be determined. This factor combined with the electronic device can determine the level of exercise.

It is also possible to adjust the strength of the hand exercising device in another fashion. An exterior clip may strength thereto as desired. With this adjustable hand exercising device, various strengths can be applied thereto for different people or different strengths of the same person. A person may have different strength levels as recovery is accomplished and strength is increased over an exercise program.

Referring now to FIG. 1, the hand exercising device 100 is molded or cut out of a solid piece of plastic. There is a first arm 122 and a second arm 124 extending from a centrally located arcuate portion 126. Adjacent the arcuate portion 126 are a first ledge 128 and a second ledge 130, one at the top of each arm respectively. First ledge 128 extends from first arm 122. Second ledge 130 extends from second arm 124. Arcuate portion 126 connects first ledge 128 to second ledge 130 by extending as an arc or part of a circle therebetween.

FIG. 1 further includes a battery-powered electronic device 110 connected by wires 112 to the hand exercising device 100. Within the hand excerise device 100 is a switch (not shown) capable of activating electronic device 110.

The slotted insert 340 of FIG. 25 is shown as inserted in arcuate portion 126 to increase or decrease the strength required to operate hand exercise device 100. Slotted insert 340 is connected to hand exercise device 100 at second arm 124 in standard fashion by a rope 302. A second rope 302 attaches a drawstring bag 304 to first arm 122. Bag 304 may contain other inserts suitable for use hand exercising device 100.

The arcuate portion 126 can receive a sleeve therebetween or therein to increase the strength required for operating the hand exercising device 100. The sleeve can be slotted insert 340, or any other suitable sleeve or insert such as those shown in the drawings. In this fashion, one hand exercising device 100 with a plurality of sleeves provided therewith can serve many different people having different strength capability. All sleeve embodiments are generally cylindrical or arcuate in shape, but may be of any suitable shape.

By considering now FIG. 2 and FIG. 3, a modification of hand exercising device 100 is shown. To receive electronic device 110, the first ledge 128 and the second ledge 130 each include an indentation or slotted switch receiver (these terms being used interchangeably herein. First ledge 128 includes a first indentation 134. Second ledge 130 includes a second indentation 136. First indentation 134 receives a first switch 116 of electronic device 110. Second indentation 136 receives a second switch 118 of electronic device 110. First switch 114 and second switch 116 combine to operate electronic device 110 when first arm 122 and second arm 124 are squeezed together. Usually a switch is related to the slotted switch receiver on a male to female relationship.

First indentation 134 and second indentation 136 permit electronic device 110 to be removed from hand exercising device 100 as desired. First indentation 134 may receive second switch 118 of electronic device 110. Second indentation 136 may receive first switch 116 of electronic device 110.

This electronic device 110 can have readouts in terms of time elapsed, number of strokes in raw form and per unit time elapsed, force of squeezing, hand force applied to the exercising device 100 or may be replaced by a similar device capable of electronically providing readouts of various other parameters. Squeezing of the hand exercising device 100 activates the switches and thereby provides a readout of a particular parameter to which the device is set.

Referring now to FIG. 4, FIG. 5 and FIG. 6, cratered exercise device 200 is substantially similar to hand exercising device 100 but for the fact that slots 202 appear in the arcuate portion 126. The slots 202 may receive probes 204. The probes 204 serve the same purpose to strengthen or weaken the gripping required. Thus, a probe 204 may be inserted into a slot 202 as desired to increase or decrease the strength of cratered device 200 as desired.

It is clear that the cratered device 200 may use other strengthening devices as shown in the other figures. Clearly, the elongated slotted sleeve 180 may used as a strengthening device. Also a chosen sleeve may be used therein, such as slotted insert 150, solid cylindrical insert 250 or hollow cylindrical insert 320. Electronic device 110 may also be mounted on cratered device 200 if desired.

In FIG. 7, FIG. 8 and FIG. 9, slotted insert 150 is shown. Slotted insert 150 is generally cylindrical in shape with wedge-shaped slot 152 therein, appearing much like a piece has been cut from a pie. The wedge-shaped slot 152 may be uniform or tapered. A uniform wedge has one strength. A tapered version has a variety of strengths depending on the postion of wedge-shaped slot 152 relative to arcuate portion 126 or 202.

Figure 11:
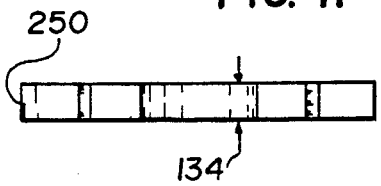
FIG. 11 depicts a top plan view of a hand exercising device 100 as shown in FIG. 10.
Figure 12:
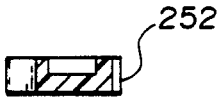
FIG. 12 depicts a cross sectional view of indentation 160 along Line 10—10.
Figure 14:
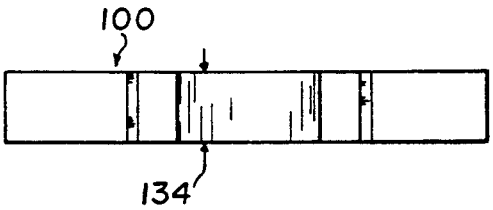
FIG. 14 depicts a top view of FIG. 13.
Figure 15:
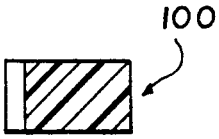
FIG. 15 depicts a cross-section of FIG. 13 along Line 15—15.

FIG. 10 depicts exercise device 100 having an indentation 160 in each of first arm 122 and second 124. Each indentation 160 may be used for decoration, advertising or similar material. Also FIG. 10 in combination with FIG. 11 and FIG. 14 depicts a strength adjustment in terms of arcuate portion 126 having a different thickness 134.

Figure 13:
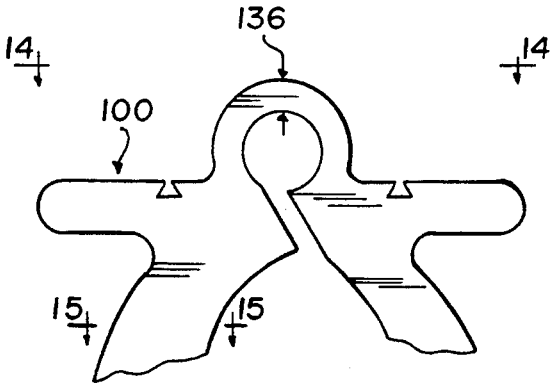
FIG. 13 depicts a partial, side view of hand exercising device 100.

FIG. 13 in combination with FIG. 10 depicts a strength adjustment in terms of arcuate portion 126 having a different width 136.

In FIG. 16, FIG. 17 and FIG. 18, solid cyclindrical insert 250 is shown. In a similar fashion, FIG. 22, FIG. 23 and FIG. 24 combine to depict a hollow cylindrical insert 320. Tapering of hollow portion 172 provides an adjustable strength.

With FIG. 19, FIG. 20 and FIG. 21, elongated insert 300 is like hollow cylindrical insert 320. Elongated insert 300 includes uniform openings 182 therein. In a similar fashion, FIG. 25, FIG. 26 and FIG. 27 combine to depict varied insert 340 with tapered openings 192 therein to provide for varied strength. Varied insert 190 is longer than arcuate portion 126 is wide at width 134. Thus, the force required varies with the position of varied insert 190 within arcuate portion.

The varied insert 340 has the form of a sleeve with a tapered slot 192 therein. With a tapered slot 192 running the length of the elongated sleeve 340, the strength added to the exercising device 100 of this invention is adjusted depending on the position of the elongated sleeve 340. The varied insert 340 can be slid through to increase or decrease the strength of hand exercising device 100 as desired. The minor protrusion of the elongated sleeve 190 above the surface of the hand exercising device 100 does not interfere with the otherwise efficient operation.

FIG. 28 depicts exercise device 100 with an outer brace 360 surrounding centrally located arcuate portion 126. Outer brace 360 extends over first ledge 128 and second ledge 130, and is clipped thereon by brace clips 322. Brace 360 adds strength to exercise device 100 or to cratered exercise device 200.

FIG. 29 depicts the movement of exercise device 100 wherein first arm 122 is stationery as second arm 124 moves. The arm contacting the fingers of a person usually is the arm that moves.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this device can become clear to a person having ordinary skill in this particular art. Such modifications are clearly covered by this disclosure.

What is claimed and sought to be protected by Letters Patent of the United States is:

1. A hand exercising device including a spring and two arms extending therefrom, comprising:

a) said spring having an adjustable strength;

b) said spring and said two arms cooperating to unitarily form said hand exercising device;

c) said two arms including a first arm and a second arm;

d) said first arm and said second arm extending from said spring, said spring being a portion centrally located therebetween;

e) a strengthening member cooperating with said hand exercising device to adjust a force required to operate said hand exercising device upwardly or downwardly; and f) said strengthening member being a rod capable of slidable insertion in said portion.

2. The hand exercising device of claim 1 being a unitary piece.

3. The hand exercising device of claim 1, having an adjustment in the thickness or width of said portion to adjust strength of said hand exercising device.

4. The hand exercising device of claim 1, comprising:

a) said portion being arcuate;

b) and said spring includes a receiving means for accepting at least one strengthening member capable of increasing the strength of said spring, thereby increasing the strength of said hand exercising device.

5. The hand exercising device of claim 4, further comprising:

a) said strengthening member being of a generally cylindrical shape; and b) said strengthening member being insertable in said portion.

6. The hand exercising device of claim 4, further comprising:

a) said strengthening member being of a generally elongated shape; and b) said strengthening member surrounding an exterior of said portion.

7. The hand exercising device of claim 4, further comprising said portion including at least one indentation in an edge thereof.

8. The hand exercising device of claim 7 being a molded plastic article.

9. The hand excising device of claim 4 being a molded plastic article.

10. The hand exercising device of claim 5 having said strengthening member of a generally cylindrical shape.

11. The hand exercising device of claim 10, having a tapering means to adjust strength of said generally cylindrical shape.

* * * * *